US007604289B2

(12) United States Patent
Chen

(10) Patent No.: US 7,604,289 B2
(45) Date of Patent: Oct. 20, 2009

(54) FOLDABLE TABLE-CHAIR ASSEMBLY

(76) Inventor: Libin Chen, Qiaoyu building, West of Boyi Town, Changzhou, Jiangsu Province (CN) 213147

( * ) Notice: Subject to any disclaimer, the term of this patent is extended or adjusted under 35 U.S.C. 154(b) by 37 days.

(21) Appl. No.: 11/987,687

(22) Filed: Dec. 4, 2007

(65) Prior Publication Data

US 2009/0140557 A1 Jun. 4, 2009

(51) Int. Cl.
*A47B 83/02* (2006.01)

(52) U.S. Cl. ..... 297/159.1; 297/158.4; 108/127

(58) Field of Classification Search ..... 297/158.3, 297/158.4, 159.1, 173, 135; 108/121, 127
See application file for complete search history.

(56) References Cited

U.S. PATENT DOCUMENTS 1,614,539 A * 1/1927 Ryan ..... 108/127
2,080,982 A * 5/1937 MacDonald ..... 297/139
5,482,398 A * 1/1996 Finke ..... 404/6
5,683,135 A * 11/1997 Williams ..... 297/159.1
6,045,177 A * 4/2000 Grace ..... 297/45
6,193,308 B1 * 2/2001 Hwang ..... 297/171
6,231,119 B1 * 5/2001 Zheng ..... 297/16.2
6,234,089 B1 * 5/2001 Zheng et al. ..... 108/115
6,454,348 B1 * 9/2002 Wu ..... 297/16.2
6,457,192 B2 * 10/2002 Choi et al. ..... 5/114
6,651,568 B1 * 11/2003 Buono ..... 108/127
7,070,230 B2 * 7/2006 Chen ..... 297/135
2004/0046428 A1 * 3/2004 Hwang ..... 297/188.2
2008/0238158 A1 * 10/2008 Jiu et al. ..... 297/158.4

* cited by examiner

*Primary Examiner*—Joseph F Edell

(57) ABSTRACT

A foldable table-chair assembly and the frame thereof. The frame has a table frame and four integral chair frames. A table panel is able to be detachably attached on the table frame. The table panel has a plurality of hard sub-panels which are foldably connected together and a covering containing the sub-panels. A chair panel is able to be detachably attached on each chair frame. The invention is able to lower the attention needed to deal with each chair and the table and be folded up and opened by a simple operation thus saving the time of storing and preparing for using.

4 Claims, 4 Drawing Sheets

FOLDABLE TABLE-CHAIR ASSEMBLY

BACKGROUND OF THE INVENTION

1. Field of the Invention

The invention relates to a foldable table-chair assembly, and more particularly, to a table-chair assembly which is able to be folded up into a small volume for storing and convey.

2. Description of the Prior Art

Foldable table and foldable chair are conventionally separate and they need to be folded up, carried, and stored one by one. When used together, a user has to open the table and the chairs one by one and place them together for sitting. This may cause some inconvenience. For example, first, folding and opening the table and the chairs one by one takes more time. And, second, in carriage and convey, a user has to deal with the table and each chair. It takes more attention and energy.

BRIEF SUMMARY OF THE INVENTION

The main object of the invention is to provide a foldable table-chair assembly and a frame thereof, in which the table and the chairs are integral and able to be handled together thus lowering the attention needed to deal with each chair and the table. Another object of the invention is to provide a foldable table-chair assembly and a frame thereof, which is able to be folded up and opened by a simple operation thus saving the time of storing and preparing for using.

In accordance with one aspect of the invention, there is provided a frame of a foldable table-chair assembly having a table frame having four identical legs each having a top end and a bottom end, a first link fixed to the top end of each leg, a pair of cross bar pivotally connected together with a second link with a free end of each cross bar being pivotally connected to one first link, a third link fixed to the bottom end of each leg, four first tilted bars with a lower end of each of them being pivotally connected to each third link, a fourth link pivotally connected to free ends of the four first tilted bars, a middle bar pivotally linking each second link to the fourth link, and, a fifth link sleevable on each leg and pivotally linking a second tilted bar to a sixth link, with each of the first tilted bars being rotatably riveted together with one of the four second tilted bars at a middle thereof; and four chair frames each having a first, a second and a third pairs of identical chair bars, each pair of which are rotatably riveted together at middles thereof, one upper end of the chair bar of each first and one upper end of the chair bar of each second pair being pivotally connected to one fifth link and lower ends of the chair bars of the same pairs being pivotally connected to one third link, another upper end of the chair bars of each first pair and another upper end of the chair bar of each second pair being respectively pivotally connected to one upper end of a chair bar of one third pair with a seventh link, another lower end of the chair bar of each first pair and another lower end of the chair bar of each second pair being respectively pivotally connected to one lower end of a chair bar of one third pair with an eighth link.

A table panel is able to be detachably attached on the table frame. The table panel has a plurality of hard sub-panels which are foldably connected together and a covering containing said sub-panels. A chair panel is able to be detachably attached on each chair frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
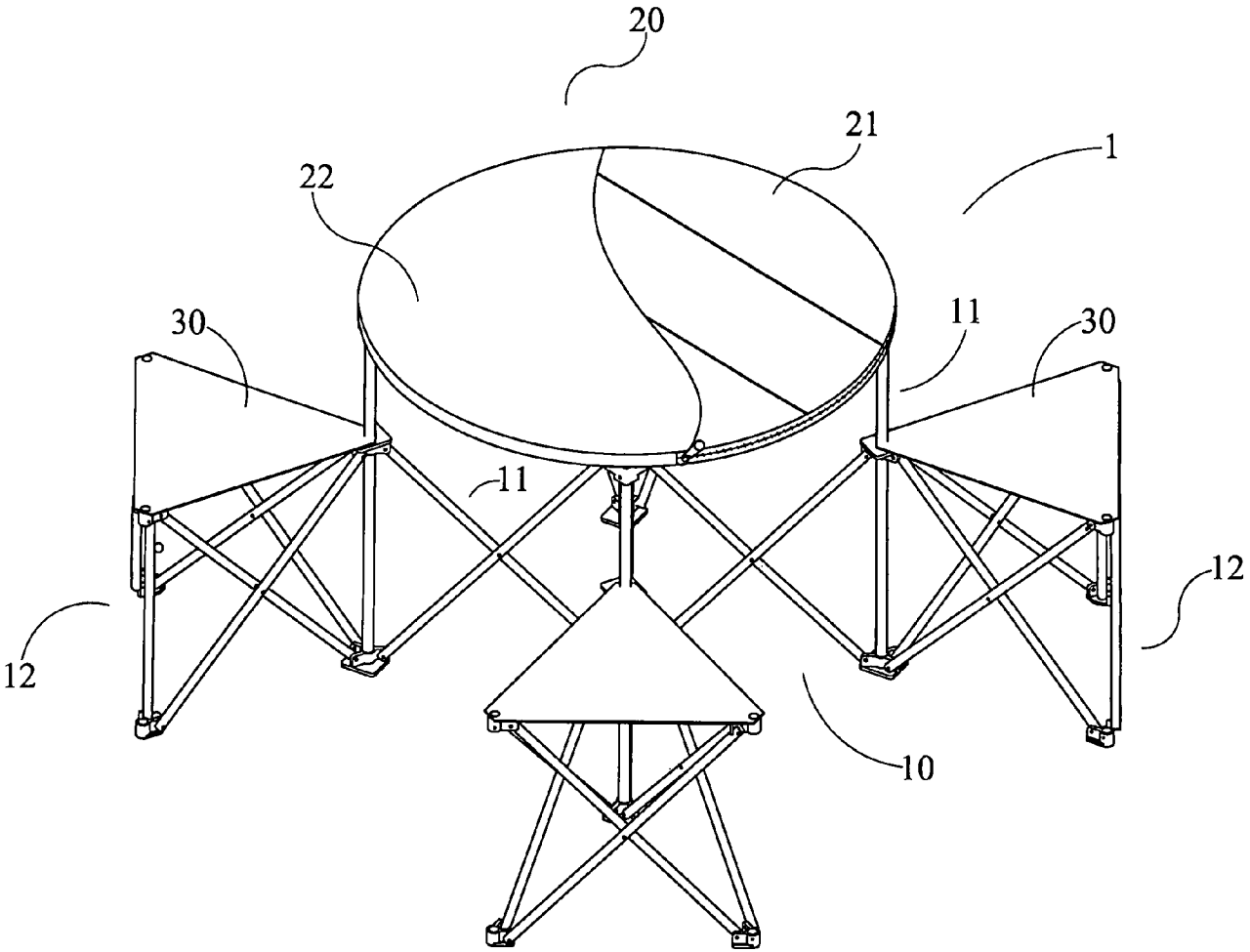
FIG. 1 is a schematic perspective view of the preferred embodiment of the foldable table-chair assembly of the invention.

With reference to FIG. 1, the preferred embodiment of a foldable table-chair assembly 1 of the invention is shown. The foldable table-chair assembly 1 has a frame 10 having a table frame 11 and four chair frames 12, a table panel 20 detachably attaching on the table frame 11, and a chair panel 30 detachably attaching on each chair frame 12.

The table panel 20 has a plurality of hard sub-panels 21 which are foldably connected together and contained in a cloth or plastic covering 22. The covering 22 is able to be detachably attached to the table frame 11. When the table panel 20 is detached from the table frame 11, the covering 22 is able to be removed from the sub-panels 21 and the sub-panels 21 are able to be folded up.

Figure 2:
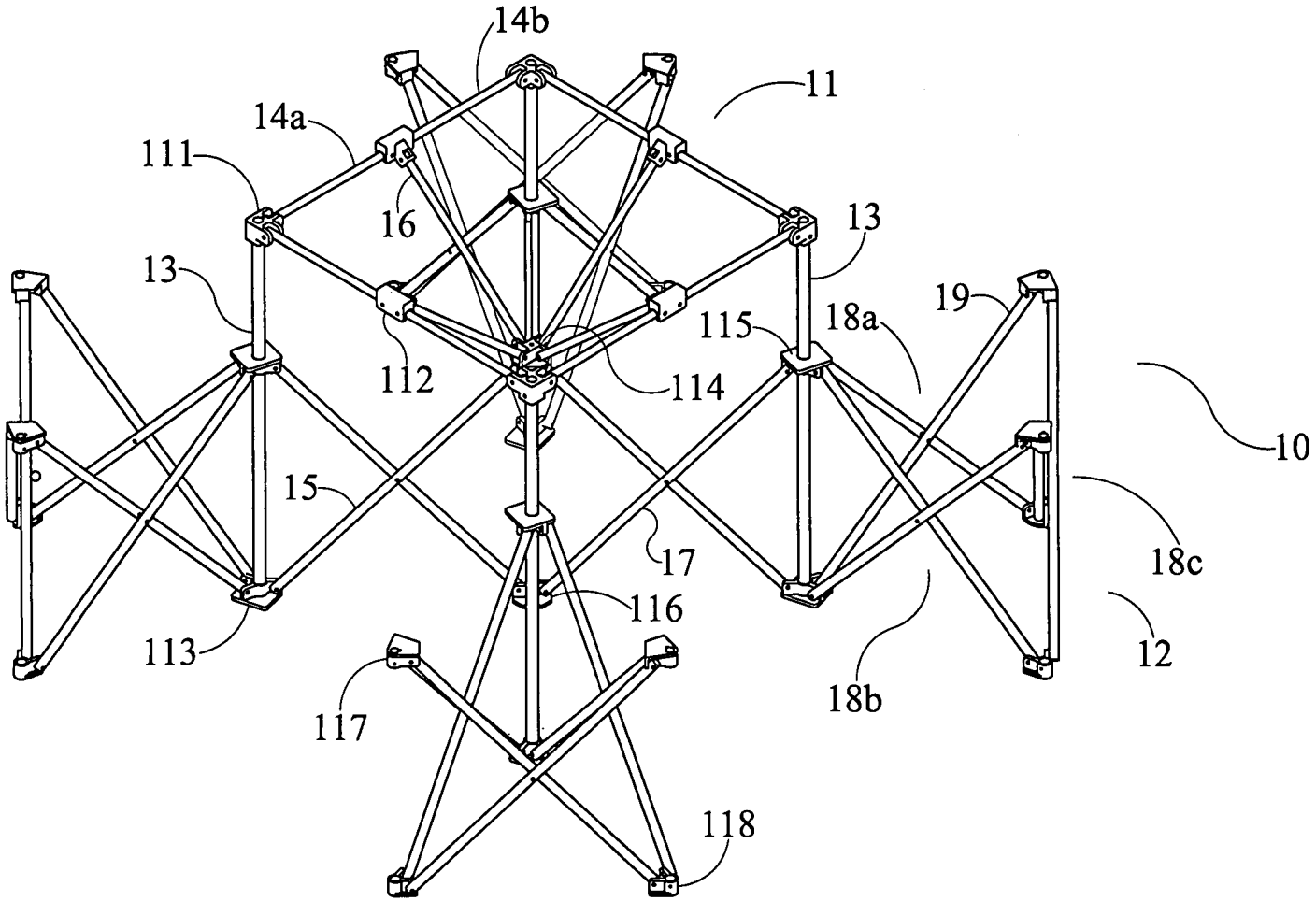
FIG. 2 is a schematic perspective view of the table-chair assembly shown in FIG. 1 without a table panel and chair panels. And, FIGS. 3 to 10 are enlarged perspective views of elements of the table-chair assembly shown in FIG. 1.
Figure 3:
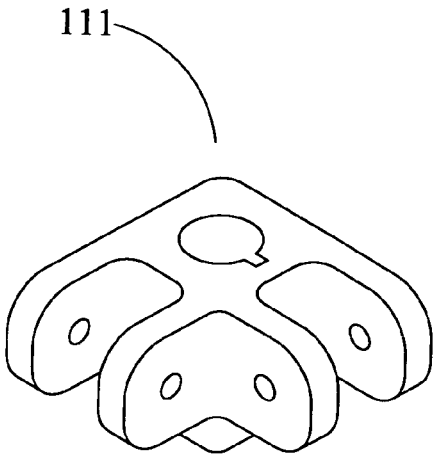
Figure 4:
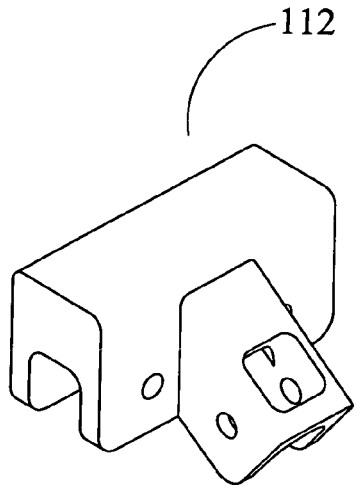
Figure 5:
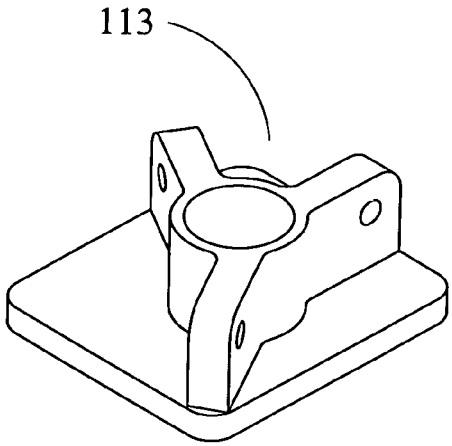
Figure 6:
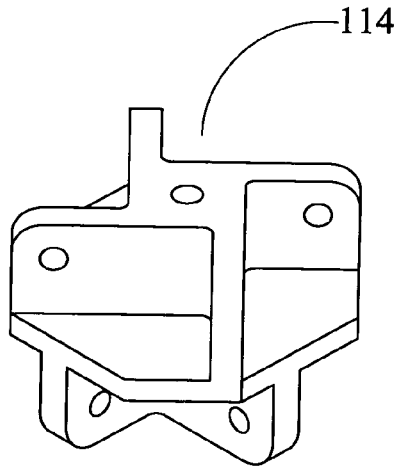
Figure 7:
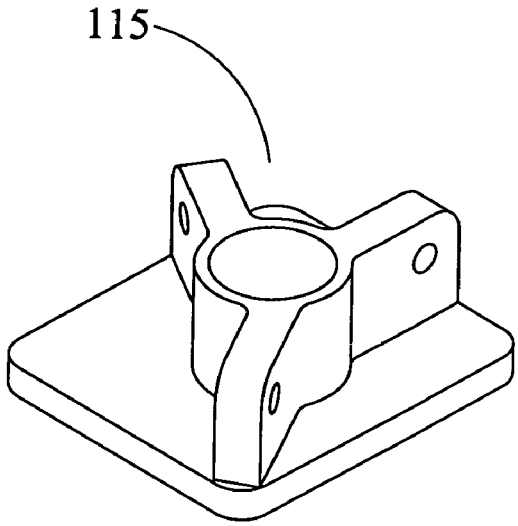
Figure 8:
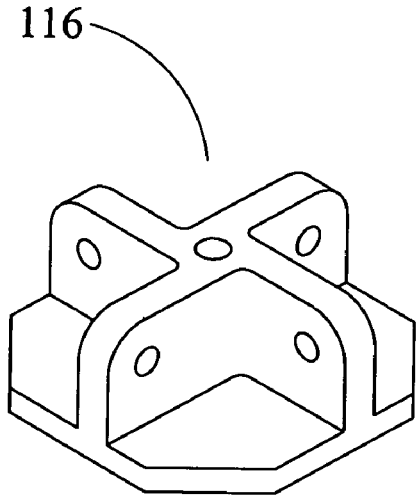

As shown in FIG. 2, the table frame 11 has four identical legs 13 each having a top end and a bottom end. A first link 111, as particularly shown in FIG. 3, is fixed to the top end of each leg 13. A pair of cross bar 14*a*, 14*b* are pivotally connected together with a second link 112, which is as particularly shown in FIG. 4. A free end of each cross bar 14*a*, 14*b* is pivotally connected to one first link 111. A third link 113, as particularly shown in FIG. 5, is fixed to the bottom end of each leg 13. Four first tilted bars 15 are provided with a lower end of each of them being pivotally connected to each third link 113. A fourth link 114, as particularly shown in FIG. 6, is pivotally connected to free ends of the four first tilted bars 15. A middle bar 16 pivotally links each second link 112 to the fourth link 114. Each of four second tilted bars 17 pivotally links a fifth link 115, which is as particularly shown in FIG. 7 and which is sleevable on each leg 13, to a sixth link 116, as particularly shown in FIG. 8. Each of the first tilted bars 15 is rotatably riveted together with one of the four second tilted bars 17 at a middle thereof.

Figure 9:
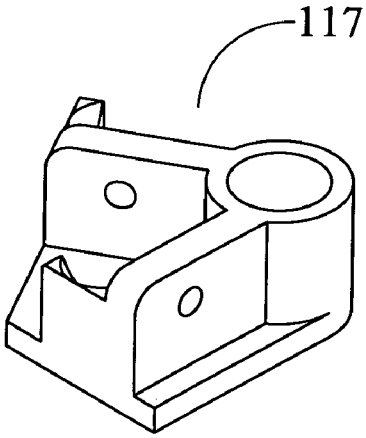
Figure 10:
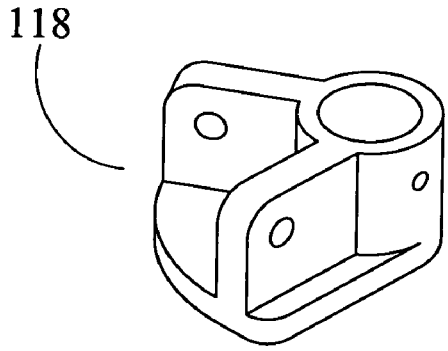

Each chair frame 12 has a first, a second and a third pairs 18*a*, 18*b*, and 18*c* of identical chair bars 19, each pair of which are rotatably riveted together at middles thereof. One upper end of the chair bar 19 of each first pair 18*a* and one upper end of the chair bar 19 of each second pair 18*b* are pivotally connected to one fifth link 115 and lower ends of the chair bar 19 of the same pairs 18*a*, 18*b* are pivotally connected to one third link 113. Another upper end of the chair bar 19 of each first pair 18*a* and another upper end of the chair bar 19 of each second pair 18*b* is respectively pivotally connected to one upper end of a chair bar 19 of one third pair 18*c* with a seventh link 117, as particularly shown in FIG. 9. Another lower end of the chair bar 19 of each first pair 18*a* and another lower end of the chair bar of each second pair 18*b* is respectively pivotally connected to one lower end of a chair bar 19 of one third pair 18*c* with an eighth link 118, as particularly shown in FIG. 10.

In use, a user is able to fold up the table-chair assembly by pushing at least one of the chair frames 12 inward. Each fifth link 115 then will go upward along the leg 13 towards the top end thereof. The four legs 13 go inward towards each other.

The sixth link 116 moves downward in a direction parallel to the leg 13 and the fourth link 114 moves upward. Each second link 112, connected to the fourth link 114 by a middle bar 16 will then driven to go upward by the fourth link 114. When the user keeps pushing the chair frame 12, the fifth links 115 reach their up most position and the four legs 13 and the chair frames 12 are folded up. The second link 112 also reach their up most position and each pair of the cross bar 14*a*, 14*b* are folded up, too. An reverse operation will be able to open the table-chair assembly 1 of the invention.

From above description, it could be seen that the foldable table-chair assembly 1 is able to be folded up and opened by a simple operation thus saving the time of storing and preparing for using. And, the table and the chairs are integral and able to be handled together thus lowering the attention needed to deal with each chair and the table.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A frame of a foldable table-chair assembly comprising:

a table frame having four identical legs each having a top end and a bottom end, a first link fixed to said top end of each said leg, a pair of cross bars pivotally connected together with a second link with a free end of each said cross bar being pivotally connected to one said first link, a third link fixed to said bottom end of each said leg, four first tilted bars with a lower end of each said first tilted bar being pivotally connected to each said third link, a fourth link pivotally connected to free ends of said four first tilted bars, a middle bar pivotally linking each said second link to said fourth link, and, a fifth link slidable along each said leg and pivotally linking a second tilted bar to a sixth link, with each of said first tilted bars being rotatably riveted together with one of said second tilted bars at a middle thereof;

four chair frames each having a first, a second and a third pairs of identical chair bars, each pair of which are rotatably riveted together at middles thereof, an upper end of a first chair bar of each said first pair and an upper end of a first chair bar of each said second pair being pivotally connected to one said fifth link, a lower end of a second chair bar of each said first pair and a lower end of a second chair bar of each said second pair being pivotally connected to one said third link, an upper end of said second chair bar of each said first pair and an upper end of said second chair bar of each said second pair being pivotally connected to upper ends of respective chair bars of one said third pair with a seventh link, and a lower end of said first chair bar of each said first pair and a lower end of said first chair bar of each said second pair being pivotally connected to lower ends of respective chair bars of one said third pair with an eighth link; and, a table panel detachably attached on said table frame.

2. The frame as claimed in claim 1, wherein said table panel has a plurality of hard sub-panels which are foldably connected together and a covering containing said sub-panels.

3. The frame as claimed in claim 2, wherein a chair panel is detachably attached on each chair frame.

4. The frame as claimed in claim 1, wherein a chair panel is detachably attached on each chair frame.

* * * * *